US010888766B2

(12) United States Patent
Grantham et al.

(10) Patent No.: US 10,888,766 B2
(45) Date of Patent: Jan. 12, 2021

(54) SKATEBOARD DECK-MOUNTABLE LAMP

(71) Applicants: Bret Nicholas Grantham, Palos Verdes Estates, CA (US); Proshad Sharifi, Palos Verdes Estates, CA (US)

(72) Inventors: Bret Nicholas Grantham, Palos Verdes Estates, CA (US); Proshad Sharifi, Palos Verdes Estates, CA (US)

( * ) Notice: Subject to any disclaimer, the term of this patent is extended or adjusted under 35 U.S.C. 154(b) by 12 days.

(21) Appl. No.: 16/513,271

(22) Filed: Jul. 16, 2019

(65) Prior Publication Data

US 2020/0316452 A1 Oct. 8, 2020

Related U.S. Application Data

(60) Provisional application No. 62/692,170, filed on Jun. 29, 2018.

(51) Int. Cl.
*A63C 17/01* (2006.01)
*A63C 17/26* (2006.01)

(52) U.S. Cl.
CPC ..... *A63C 17/012* (2013.01); *A63C 17/26* (2013.01); *A63C 2203/14* (2013.01)

(58) Field of Classification Search
CPC .... A63C 17/012; A63C 17/26; A63C 2203/14
See application file for complete search history.

(56) References Cited

U.S. PATENT DOCUMENTS

| | | | | |
|---|---|---|---|---|
| 9,366,404 | B1 | 6/2016 | Porter et al. | |
| 2008/0265539 | A1* | 10/2008 | Gregorio | A63C 17/26 280/87.041 |
| 2014/0321150 | A1 | 10/2014 | Sandiford | |
| 2015/0192263 | A1* | 7/2015 | Fissell | F21S 10/02 362/545 |

OTHER PUBLICATIONS

Anrushee, "DIY Skateboard Lamp Tutorial," Anushree's Craft TV, Jun. 22, 2017.
Autodesk, Inc., "Hanging Skateboard Light," www.instructables.com, Dec. 19, 2018.
Imgur, "Skateboard Light," www.imgur.com, Feb. 23, 2013.

* cited by examiner

*Primary Examiner* — Donald L Raleigh
(74) *Attorney, Agent, or Firm* — Seyfarth Shaw LLP; Puya Partow-Navid

(57) ABSTRACT

A skateboard deck lamp is presented. The skateboard deck lamp includes a deck comprising truck holes, a standing surface, an underside surface. The truck holes were originally intended to couple the deck to a wheel axle truck assembly. The skateboard deck lamp also includes a truck assembly coupled to the underside surface. The truck assembly includes a base plate and a central portion. The base plate includes openings aligned with the truck holes, and the central portion includes a socket for receiving a light source. The skateboard deck lamp also includes a power supply conduit coupled to the standing surface. The power supply conduit receives electricity from a power source. The skateboard deck lamp also includes a lamp wire coupled with the power supply conduit and the socket via at least one truck hole of the truck holes.

14 Claims, 9 Drawing Sheets

SKATEBOARD DECK-MOUNTABLE LAMP

CROSS-REFERENCE TO RELATED APPLICATIONS

This application claims the benefit of U.S. Provisional Patent Application No. 62/692,170, titled "SKATEBOARD DECK-MOUNTABLE SKATEBOARD TRUCK LAMP," filed on Jun. 29, 2018, the disclosure of which is expressly incorporated by reference herein in its entirety.

TECHNICAL FIELD

The present disclosure generally relates to a recreational or sport board configured for lighting. More specifically, the present disclosure relates to a skateboard deck-mountable skateboard truck lamp.

BACKGROUND

Skateboarders may keep their skateboards years after the board is retired from use. After the skateboard's retirement, it is desirable to put the skateboard to a functional use while also maintaining the board's original aesthetic design. Alternatively, skateboard decks can be made into lamps without ever riding them.

SUMMARY

In one aspect of the present disclosure, a skateboard deck lamp is disclosed. The skateboard deck lamp includes a deck with truck holes, a standing surface, an underside surface. The truck holes were originally intended to couple the deck to a wheel axle truck assembly. The skateboard deck lamp also includes a truck assembly coupled to the underside surface. The truck assembly also includes a base plate and a central portion. The base plate includes openings aligned with the truck holes. The central portion includes a socket for receiving a light source. The skateboard deck lamp further includes a power supply conduit coupled to the standing surface. The power supply conduit receives electricity from a power source. The skateboard deck lamp still further includes a lamp wire coupled with the power supply conduit and the socket via at one or more of the truck holes.

In another aspect of the present disclosure, a method for creating a light assembly via a skateboard deck is disclosed. The method includes coupling a truck assembly to an underside surface of the skateboard deck via truck holes of the skateboard deck. The method also includes coupling a power conduit to a standing surface of the skateboard deck via the truck holes. The method further includes coupling a lamp wire between a socket of the truck assembly and the power conduit. The method still further includes coupling a light source to the socket.

This has outlined, rather broadly, the features and technical advantages of the present disclosure in order that the detailed description that follows may be better understood. Additional features and advantages of the present disclosure will be described below. It should be appreciated by those skilled in the art that this present disclosure may be readily utilized as a basis for modifying or designing other structures for carrying out the same purposes of the present disclosure. It should also be realized by those skilled in the art that such equivalent constructions do not depart from the teachings of the present disclosure as set forth in the appended claims. The novel features, which are believed to be characteristic of the present disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following description taken in conjunction with the accompanying drawings.

DETAILED DESCRIPTION

Figure 1A:
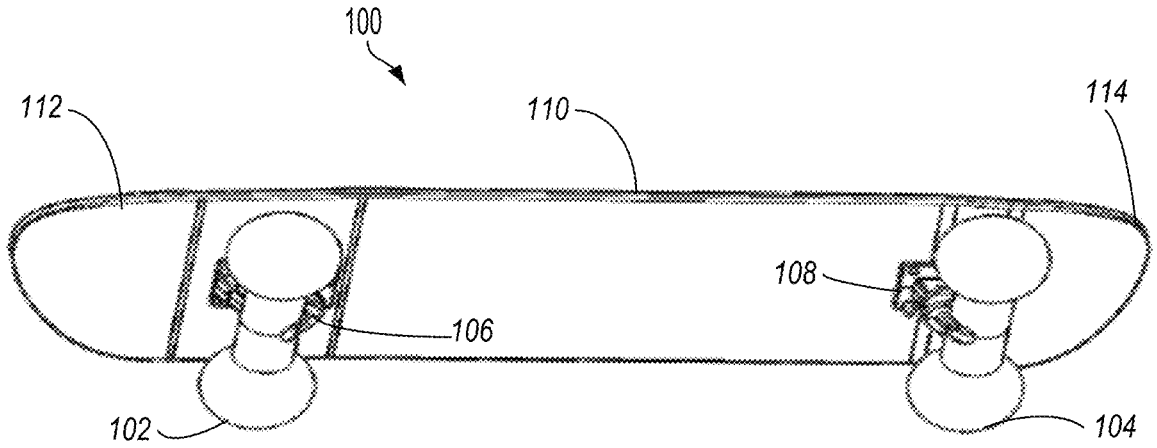
FIGS. 1A and 1B respectively illustrate a bottom view and a side view of a skateboard lamp, according to aspects of the present disclosure.

The detailed description set forth below, in connection with the appended drawings, is intended as a description of various configurations and is not intended to represent the only configurations in which the concepts described herein may be practiced. The detailed description includes specific details for the purpose of providing a thorough understanding of the various concepts. However, it will be apparent to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

Skateboarders may keep their skateboards years after the board is retired from use. For example, the skateboard may be kept for nostalgia. After the skateboard's retirement, it may be desirable to re-purpose the skateboard while maintaining the board's original design. For example, a skateboard may be re-purposed as an accent piece. A skateboard lamp is an example of an accent piece. Accent pieces, such as skateboard lamps are not limited to previously used skateboards. New skateboards (e.g., unused skateboards) may also be used as accent pieces, such as skateboard lamps.

A wheel axle assembly of a skateboard may be referred to as a truck assembly or simply a truck. In the present disclosure, to distinguish the truck assembly used for the lamp from the original truck assembly, the original truck assembly may be referred to as a wheel axle truck assembly, wheel truck assembly, or wheel truck. The truck assembly for the lamp may be referred to as a lamp truck assembly or lamp truck. A skateboard may include a skateboard deck with a pair of wheel trucks secured to the underside of the skateboard deck at opposite ends (e.g., nose and tail ends). In most cases, each wheel truck includes a base plate and a hanger.

The base plate is a base layer, or foundation, of the wheel truck assembly. The base plate is statically secured to the skateboard deck. For example, the base plate is mounted to the skateboard with four bolts. The hanger is secured to the base plate via a kingpin and compressible bushings that permit the hanger to pivot relative to the base plate and skateboard deck. The hanger includes an axle to which wheels can be secured. Generally, a complete skateboard comprises the skateboard deck, two wheel trucks, and four wheels.

The base plate may be statically secured to an underside of the skateboard deck by inserting a bolt through mounting holes (e.g., truck holes) of the skateboard deck and matching holes on the base plate. The kingpin protrudes downward from the base plate. For example, the base plate may include a base and a bearing platform. In one aspect, the base is a substantially rectangular plate having a finite thickness through which the matching holes are defined. The matching holes are configured to mount the base plate to the underside of the skateboard deck. The bearing platform projects upward from the base to form a recess on its underside.

Skateboarders may keep their skateboards years after the board is retired from use. After the skateboard's retirement, it is desirable to re-purpose the skateboard for uses other than a transportation device, while also maintaining the skateboards original design. For example, the skateboard may be re-purposed as an accent piece. Aspects of the present disclosure are directed to a skateboard lamp that uses a skateboard as a lamp fixture. The lamp fixture may use a new or used skateboard.

Regardless of whether the skateboard is old (e.g., used) or new, it is desirable to maintain an original structure of the skateboard. To prevent additional drilling, which may ruin the board, aspects of the present disclosure use the skateboard's existing truck holes. These truck holes were originally intended to couple the skateboard to a truck assembly that included a wheel axle. The wheel axle is an apparatus that holds the wheels.

Bolts and nuts are generally used to attach a wheel truck assembly to a skateboard deck having a standing surface and an underside surface. Holes (e.g., truck holes that match a truck assembly hole) are drilled into the skateboard deck based on the bolt pattern of the wheel truck assembly.

In one aspect of the present disclosure, one or more of the original truck holes may be used for traversing power supply wires/cables/cords for powering the bulbs of the skateboard lamp. The wires may be referred to as lamp wires. As such, the original skateboard deck with the original truck holes is maintained. In one configuration, the original wheel truck assembly is reconfigured into a lamp truck assembly. In another configuration, a lamp truck assembly replaces to original wheel truck assembly. The resulting lamp truck assembly includes lamp truck assembly holes that match the original truck holes of the skateboard deck. The lamp truck assembly includes the light source fixture. The light source fixture may include a socket for a light source, such as light bulb.

The skateboard lamp is designed using the lamp truck assembly coupled to the skateboard deck. In one configuration, the light source (e.g., light bulbs) appear as the wheels of the skateboard. Aspects of the present disclosure provide a power supply conduit (e.g., light box) that uses the original truck holes of the skateboard deck to pass power through to the lamp truck assembly, which houses the light source. The power supply conduit may also be used to mount the skateboard to a surface (e.g., wall). For example, the power supply conduit may include an attachment portion for attaching the skateboard lamp to the wall. The lamp truck assembly is coupled to the power supply conduit.

In one configuration, the skateboard lamp is powered by a power source, such as a wall socket or battery. The power source is coupled, via power source wires or other connections, to one or more of the power conduits. A lamp wire passes through one or more power supply conduits or boxes. For example, the lamp wire passes through two power supply conduits that are attached to the skateboard deck. A first conduit (e.g., tail box) may be coupled to a tail of the skateboard deck. A second conduit (e.g., nose box) may be coupled to a nose of the skateboard deck.

In one aspect, a first set of lamp wires traverse the tail box to provide power to light bulbs coupled to a tail truck assembly. A second set of lamp wires traverse the nose box to a nose truck assembly to supply power to light bulbs coupled to the nose truck assembly. For example, a lamp wire is split (e.g., into a first lamp wire and a second lamp wire) in the tail box to provide power to the tail truck assembly using the first lamp wire. The remainder of the split power wire (e.g., second lamp wire) runs up through the nose box to the bottom of the nose truck assembly to provide power to the nose truck assembly. In one configuration, the nose box and the tail box have separate lamp wires. Each of the lamp wires includes a hot wire and a neutral wire.

Each power supply conduit includes two small junction boxes, one for the power/hot wire and one for the ground/neutral wire. These junction boxes provide power to the lamp wires via the power source. The first lamp wire and the second lamp wire pass through one or more (e.g., two) of the truck holes (e.g., bolt holes) of the skateboard deck. For example, each of the hot wire and the ground wire may be passed from the truck lamp piece, through different truck holes, and plugged into the junction boxes in each power supply conduit. The top of the power supply conduit may be secured to the skateboard deck using bolts and nuts. On the other side (e.g., underside surface) of the skateboard deck, the lamp truck assemblies align with their corresponding power supply conduits. The lamp truck assembly and its corresponding power supply conduit are attached via bolts and nuts to the skateboard deck.

In one configuration, each lamp truck includes two lamp sockets. The two lamp sockets are wired together, such that resultant hot and neutral wires are wired to their corresponding junction boxes. For example, the hot wire is passed through a first truck hole, and the neutral wire is passed through a second truck hole. When the power supply conduits and the truck assemblies are connected, the circuit is completed, and the lamp can be powered. The resultant fixture can be used as a light source or decorative accent.

As noted, bolts and nuts are generally used to attach a skateboard truck assembly with wheels to a skateboard deck having a standing surface and an underside surface. Holes (e.g., truck holes that match a truck assembly hole) are drilled into the skateboard deck based on the bolt pattern of the truck assembly. An issue associated with using the original wheel truck assembly is that the base plate of the wheel truck assembly is not configured to receive lamp wires for powering the light bulbs of the skateboard lamp. Accordingly, the lamp wires end up being exposed or awkwardly positioned, thereby subjecting the lamp wires to damage. Therefore, the use of the wheel truck assembly is dangerous. Additionally, the exposed wires are not aesthetically pleasing.

Conventional skateboard lamps use additional holes to accommodate the wiring. The additional holes are drilled out of the original board for the specific purposes of accommodating the wiring and/or housing. As such, the additional holes ruin the original skateboard. Therefore, it is desirable to use a skateboard's existing holes for accommodating the wiring and/or housing.

Some truck assembly holes traverse the entire finite thickness of the base of the truck assembly. Thus, when the lamp wires are passed through unused truck holes of the skateboard and through unused truck assembly holes, the lamp wires end up being exposed to the exterior of the truck assembly or awkwardly positioned causing damage to the lamp wires.

To mitigate this issue, a flush wire gap is defined within the base plate of the truck assembly adjacent to the truck assembly hole. The truck assembly includes the base plate (e.g., at the periphery of the truck assembly) and a central portion or bearing platform (that is hollowed) that leads to the socket connections for the light bulbs of the skateboard lamp. In one aspect, the flush wire gap is between the underside surface of the skateboard deck and underside of the base plate. This flush wire gap creates a path for the lamp wire to be directed from the truck assembly hole to the socket connections of the light bulbs via the central portion of the truck assembly. Thus, the lamp wire traverses the truck assembly to provide power to the light bulbs without being squeezed, damaged, or unnecessarily exposed.

Aspects of the present disclosure are not limited to skateboards. The aspects of the present disclosure are also contemplated for other types of equipment (e.g., boards), such as snowboards, skis, etc.

Figure 1B:
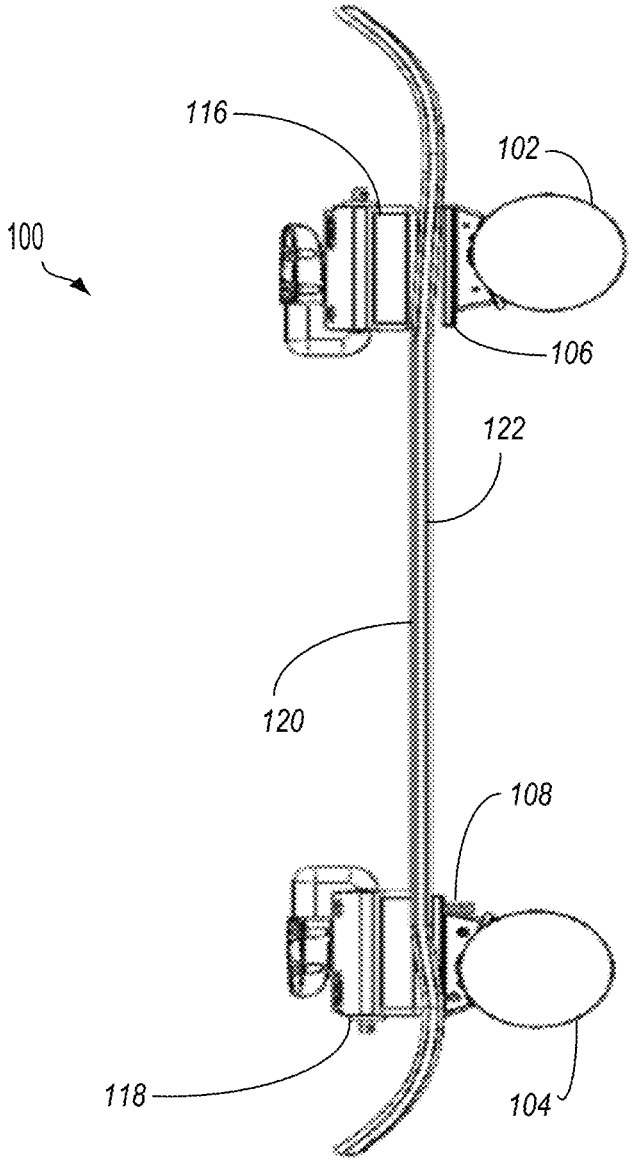

FIGS. 1A and 1B respectively illustrate a bottom view and a side view of a skateboard lamp 100, according to aspects of the present disclosure. The skateboard lamp 100 includes a skateboard deck 110, a first set of light bulbs 102, a second set of light bulbs 104, a first lamp truck assembly 106, and a second lamp truck assembly 108. The skateboard deck 110 includes a nose portion 112 and a tail portion 114. The skateboard deck 110 also includes a standing surface 120 and an underside surface 122. The first lamp truck assembly 106 is adjacent to the nose portion 112 and the second lamp truck assembly 108 is adjacent to the tail portion 114. The first set of light bulbs 102 are coupled to the first lamp truck assembly 106 and the second set of light bulbs 104 are coupled to the second lamp truck assembly 108.

A first power supply conduit 116 (e.g., light box) is coupled to the standing surface 120 and the first lamp truck assembly 106 via truck holes (not shown) of the skateboard deck 110. For example, some of the truck holes are used for passing a lamp wire or cable/cord from a power supply (not shown) to the first set of light bulbs 102. A second power supply conduit 118 is coupled to the standing surface 120 and the second lamp truck assembly 108 via other truck holes (not shown) of the skateboard deck 110. For example, some of the other truck holes are used for passing a lamp wire from a power supply (not shown) to the second set of light bulbs 104.

Figure 2:
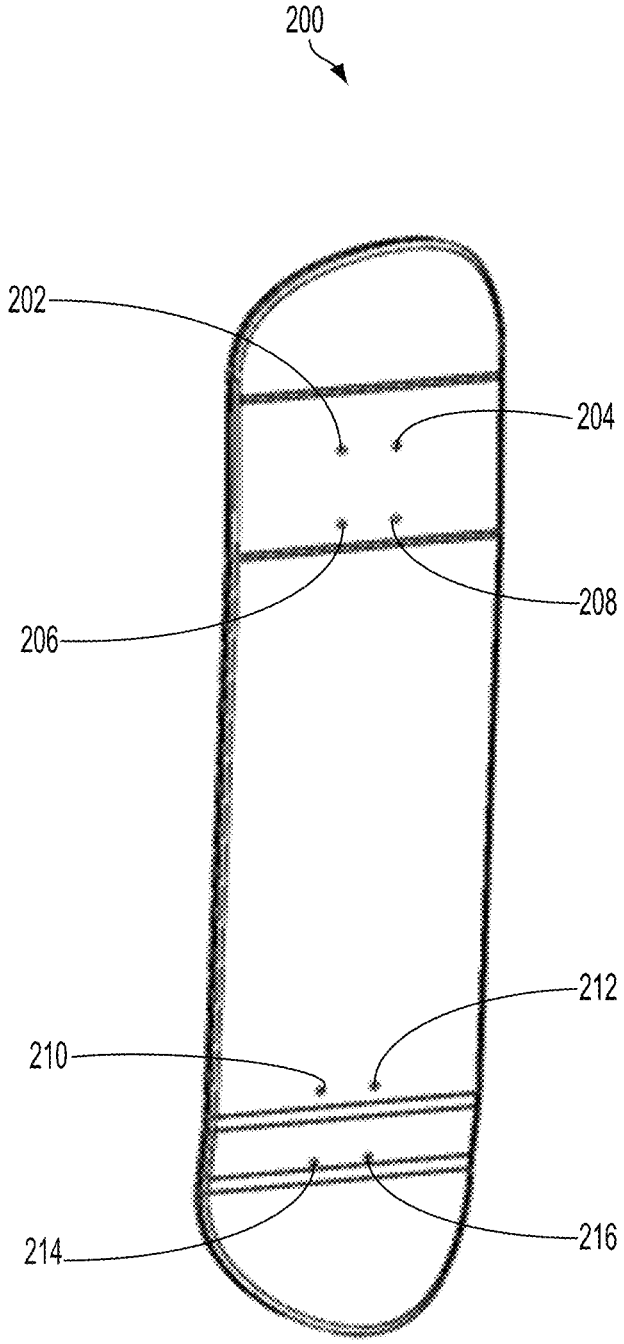
FIG. 2 illustrates a skateboard deck with truck holes that were originally intended for coupling the skateboard deck to a skateboard truck assembly.

FIG. 2 illustrates a skateboard deck 200 with truck holes that were originally intended for coupling a skateboard deck to a skateboard truck assembly. The skateboard deck 200 includes a first set of truck holes 202-208 at a nose portion 220 of the skateboard deck 200 and a second set of truck holes 210-216 at a tail portion 230 of the skateboard deck 200. Some of the truck holes (e.g., truck holes 202 and 208) at the nose portion 220 of the skateboard deck 200 may be used for routing a lamp wire (not shown) to provide power supply to the light bulbs. Others of the truck holes (e.g., truck holes 204 and 206) at the nose portion 220 of the skateboard deck 200 may be used for securing the first lamp truck assembly 106 (shown in FIGS. 1A and 1B) and the first power supply conduit 116 to opposite sides of the skateboard deck 200.

Figure 3A:
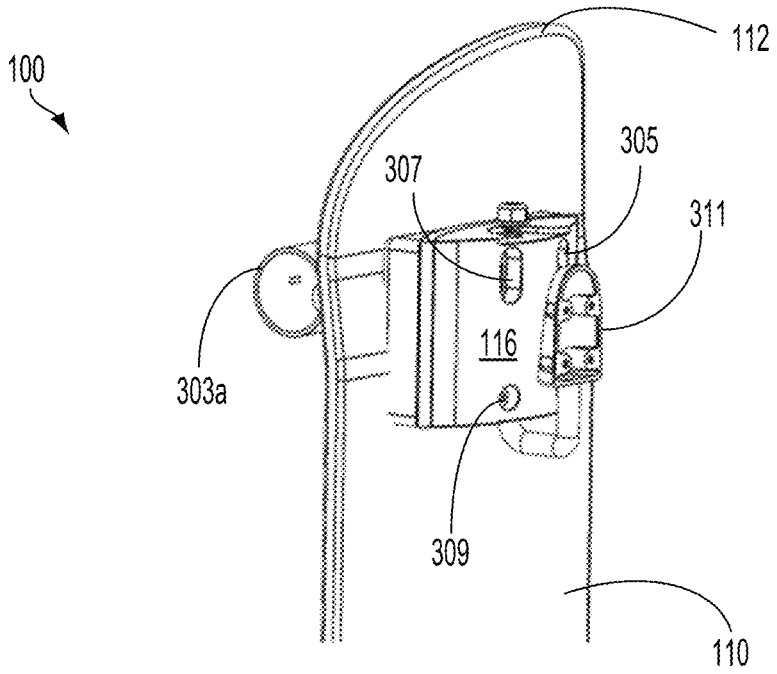
FIGS. 3A and 3B illustrate side views of a nose portion of the skateboard lamp of FIGS. 1A and 1B, according to aspects of the present disclosure.
Figure 3B:
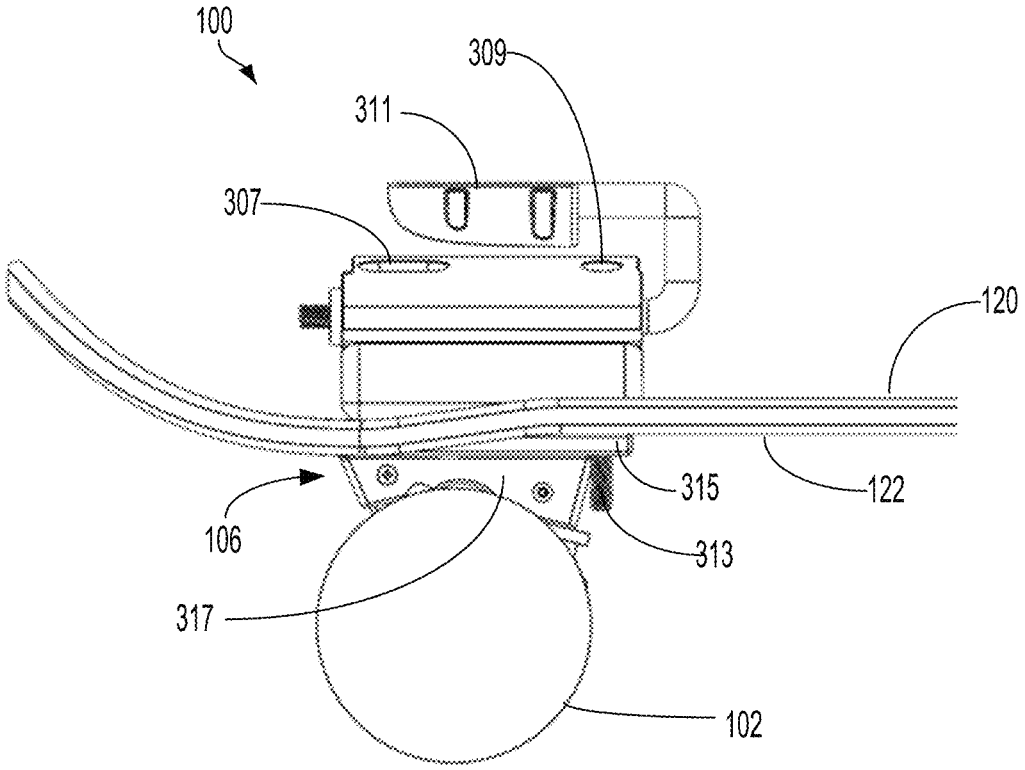

FIGS. 3A and 3B illustrate side views of the nose portion 112 of the skateboard lamp 100 of FIGS. 1A and 1B, according to aspects of the present disclosure. For illustrative purposes, some of the devices and features of FIGS. 1A and 1B are similar to those of FIGS. 3A and 3B. The first power supply conduit 116 includes a mount 311 to attach the skateboard lamp 100 to a surface such as a wall. The first power supply conduit 116 further includes conduit holes (e.g., conduit holes 305, 307, and 309) through which a power wire may be routed. The first lamp truck assembly 106 includes a base plate 315 and a central portion 317, which is hollowed. Although only three conduit holes are shown, the total number of conduit holes (e.g., four) may be as many as the truck holes, such that the conduit holes and the truck holes are matched. For example, two of the conduit holes are for the bolts and the remaining two are for the wires.

For example, the base plate 315 of the first lamp truck assembly 106 is coupled to the skateboard deck 110 by inserting a bolt 313 through the truck hole 206 of the skateboard deck 110 and a matching hole (e.g., one of the truck assembly holes 405-411 shown in FIGS. 4A and 4B) of the base plate 315 of the first lamp truck assembly 106. Another truck hole (e.g., the mounting hole 202 of FIG. 2) of the skateboard deck 110 may be used for routing a lamp wire (not shown) to provide power supply to the light bulb 102. For example, the lamp wire may pass through the truck hole 202, a matching hole (not shown) of the base plate 315, through the central portion 317 to a socket of the light bulb 102 such that power is supplied to the light bulb 102.

Figure 4A:
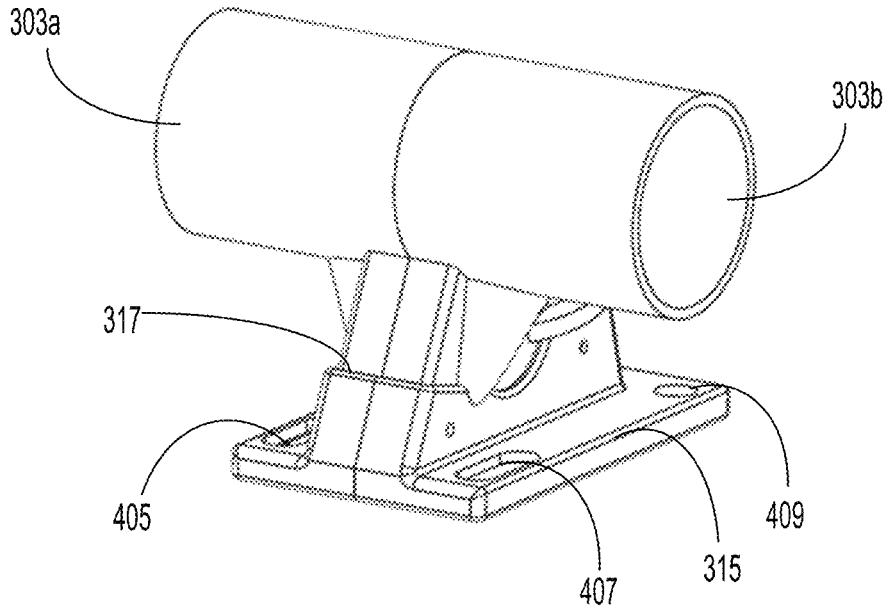
FIGS. 4A and 4B illustrate front and back views of a skateboard truck assembly of the skateboard lamp of FIGS. 1A and 1B, according to aspects of the present disclosure.
Figure 4B:
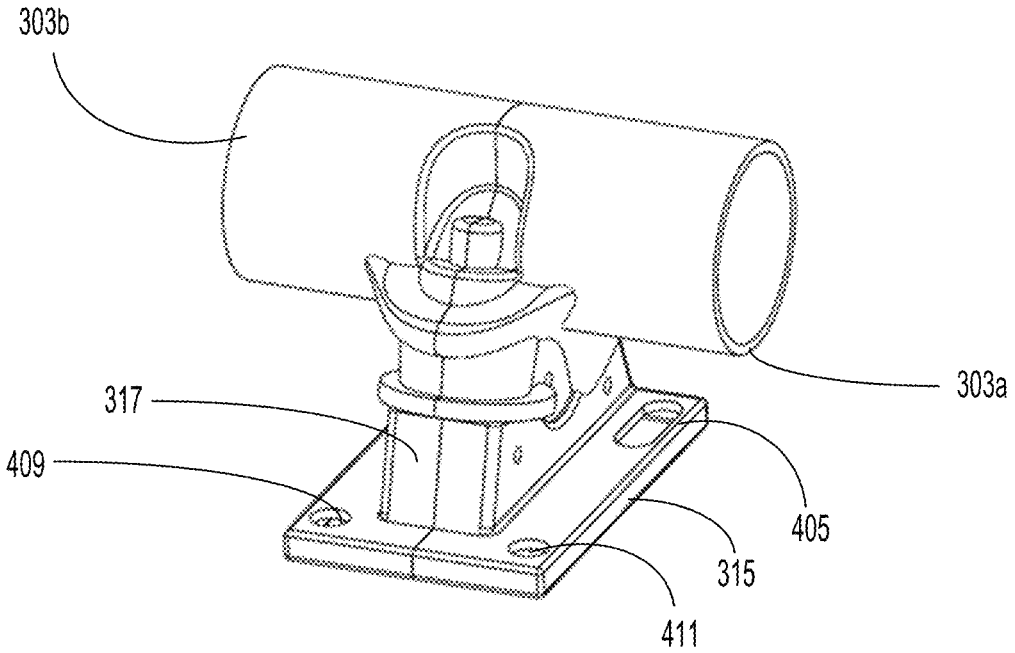

FIGS. 4A and 4B illustrate front and back views of a skateboard truck assembly (e.g., the first lamp truck assembly 106) of the skateboard lamp 100 of FIGS. 1A and 1B, according to aspects of the present disclosure. For illustrative purposes, some of the devices and features of FIGS. 4A and 4B are similar to those of FIGS. 3A and 3B. The lamp truck assembly includes a first light bulb socket 303*a* coupled to a second light bulb socket 303*b*. The first light bulb socket 303*a* is configured to receive a first light bulb (not shown) and the second light bulb socket 303*b* is configured to receive a second light bulb (not shown). The lamp truck assembly includes the base plate 315 and the central portion 317, which is hollowed. Although the base plate 315 and the central portion 317 are labelled separately, they form a single integrated unit (e.g., first lamp truck assembly 106).

Figure 5A:
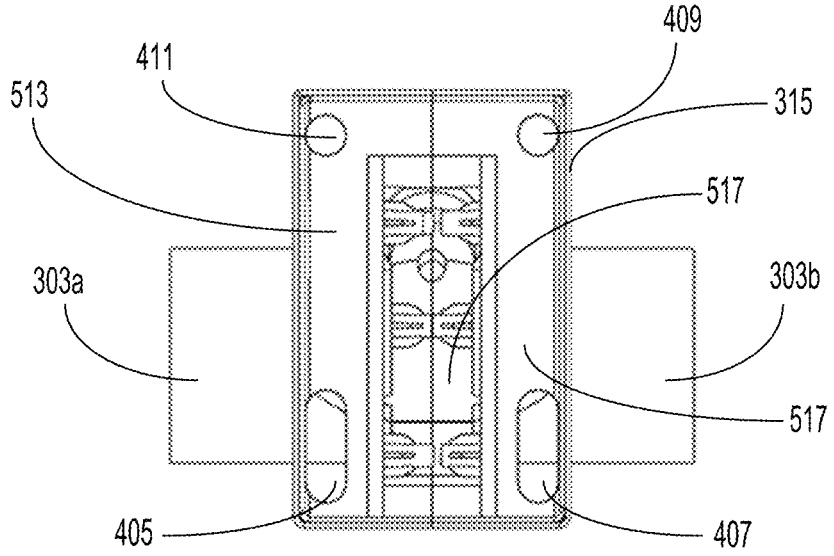
FIGS. 5A and 5B illustrate top and bottom views of the skateboard truck assembly for the skateboard lamp 100 of FIGS. 1A and 1B, according to aspects of the present disclosure.
Figure 5B:
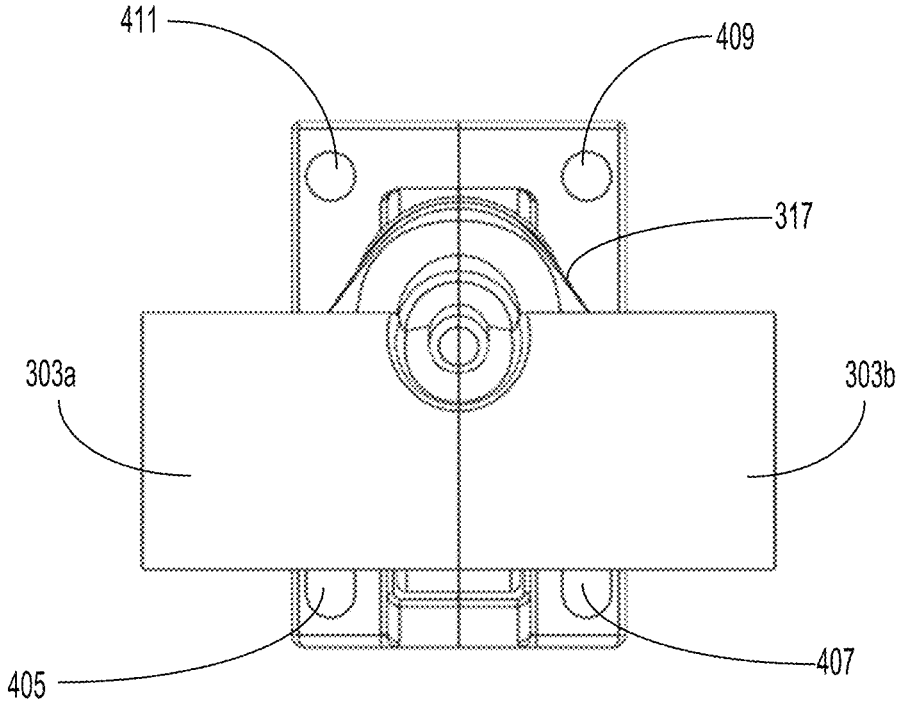

FIGS. 5A and 5B illustrate top and bottom views of a skateboard truck assembly (e.g., the first lamp truck assembly 106) for the skateboard lamp 100 of FIGS. 1A and 1B, according to aspects of the present disclosure. For illustrative purposes, some of the devices and features of FIGS. 5A and 5B are similar to those of FIGS. 4A and 4B. A flush wire gap 513 is defined within the base plate 315 of the truck assembly adjacent to one or more of the truck assembly holes 405, 407, 409, and 411. The truck assembly includes the base plate 315 and a hollowed region 517 of the central portion 317 that leads to the socket connections (not shown) for the light bulbs of the skateboard lamp 100.

In one aspect, the flush wire gap 513 is between the underside surface of the skateboard deck and underside of the base plate 315. A flush wire gap 513 creates a path for a lamp wire (not shown) to be directed from the power supply conduit to the socket connections of the light bulbs via the hollowed region 517 of the truck assembly. Conventionally, however, a base plate does not include the flush wire gap 513, and all of the truck assembly holes 405, 407, 409, and 411 are used to secure the truck assembly to the skateboard deck. In contrast, aspects of the present disclosure include the flush wire gap 513 to run the lamp wire through the truck assembly to provide power to the light bulbs without the lamp wire being squeezed, damaged, or unnecessarily exposed. In some aspects, only some of the truck assembly holes 405, 407, 409, and 411 are used to secure the truck assembly to the skateboard deck while the remaining truck assembly holes are unused to avoid squeezing the lamp wire.

Figure 6:
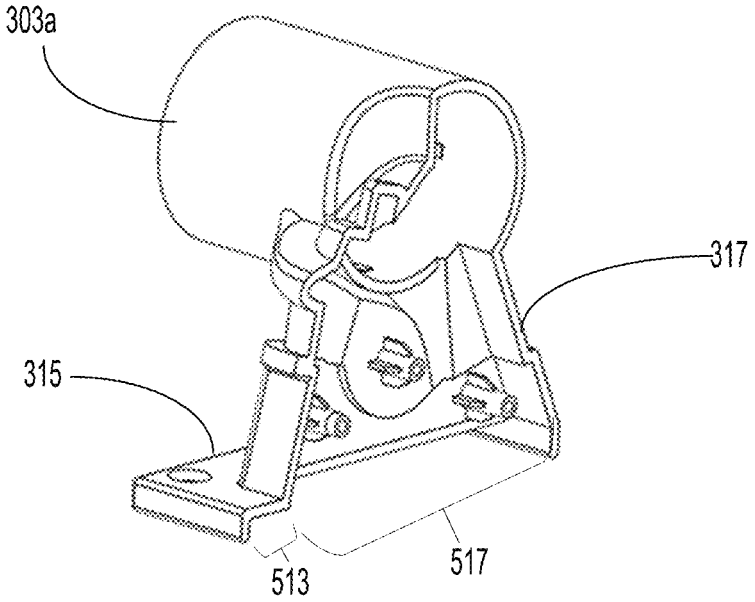
FIG. 6 illustrates a flush wire gap and a hollowed region of the central portion of the skateboard truck assembly of FIG. 5A, according to aspects of the present disclosure.

FIG. 6 illustrates a view of the flush wire gap 513 and the hollowed region 517 of the central portion 317 of the lamp truck assembly of FIG. 5A, according to aspects of the present disclosure. Because the base plate 315 is matched with the original truck holes (e.g., truck holes 202, 204, 206, and 208), the space created by the flush wire gap 513 allows a lamp wire that is run through one of the original truck holes to seamlessly traverse the bottom area of the base plate 315 to the hollowed region 517 of the central portion 317 to be coupled to the socket connections of the first light bulb socket 303*a*. For example, the hot wire is run through a first truck hole and the neutral wire is run through a second truck hole. These wires (e.g., the hot wire and the neutral wire) are split and are connected to both truck sockets. This means one hot wire powers both sockets.

Figure 7A:
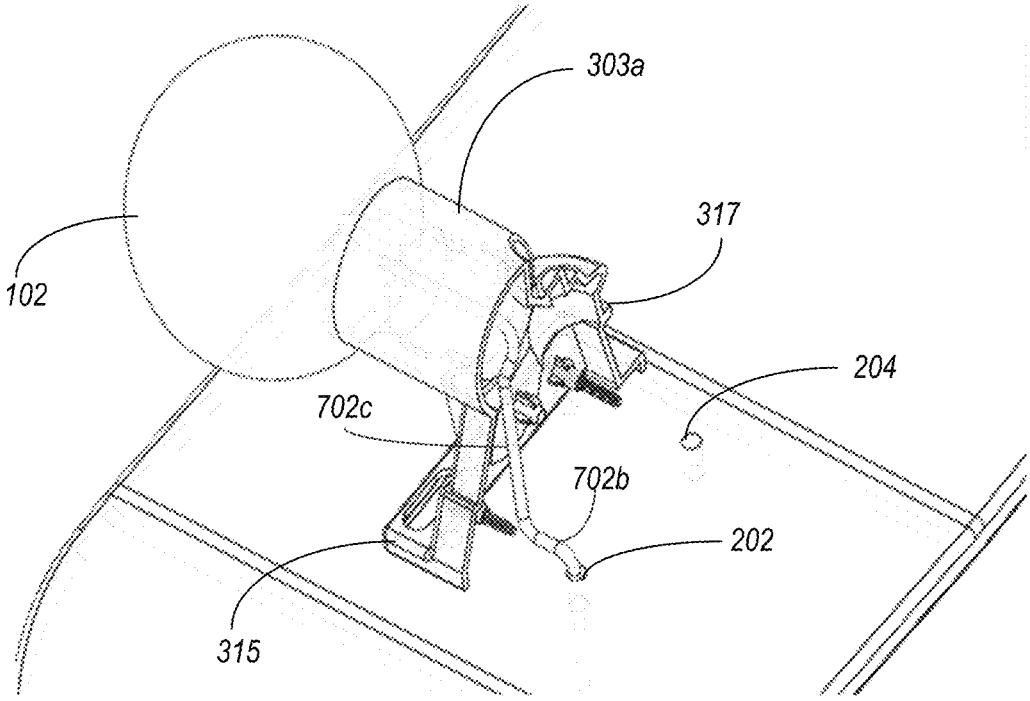
FIGS. 7A and 7B illustrate an exemplary layout of a lamp wire within the skateboard lamp, according to aspects of the present disclosure.
Figure 7B:
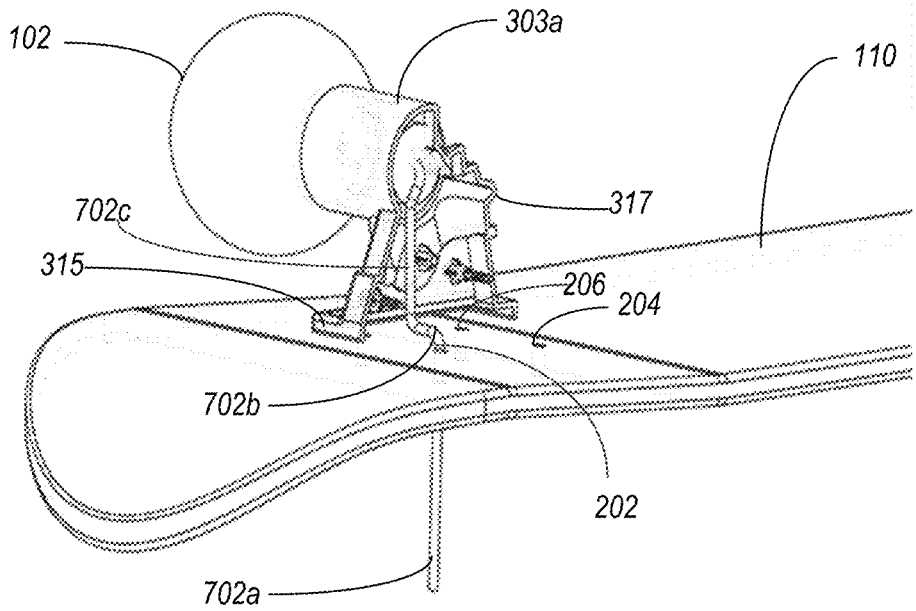

FIGS. 7A and 7B illustrate an exemplary layout of a lamp wire within a skateboard lamp, according to aspects of the present disclosure. For illustrative purposes, some of the devices and features of FIGS. 7A and 7B are similar to those of FIGS. 5A and 5B. For illustrative purposes, the lamp wire is divided into multiple sections. The multiple sections of the lamp wire include a first lamp wire section 702*a*, a second lamp wire section 702*b*, and a third lamp wire section 702*c*. The first lamp wire section 702*a* is the region of the power wire between a power supply source (not shown) and the skateboard deck 110 and is usually within the power supply conduit (not shown).

The lamp wire is threaded through the skateboard deck (e.g., the skateboard deck 110) via one of the truck holes (e.g., truck holes 202, 204, 206, or 208) where the second lamp wire section 702*b* is shown to seamlessly traverse the flush wire gap 513 between the base plate 315 and the underside of the skateboard deck 110. For illustrative purposes, the section of the base plate 315 that should be covering the second lamp wire section 702*b* is removed. The constraint introduced by the base plate 315 manifests in the bend associated with the lamp wire. For example, the second lamp wire section 702*b* bends, where the lamp wire seamlessly traverses the bottom area of the base plate 315. The flush wire gap 513 area created between the base plate 315 and the underside of the skateboard deck 110 creates the space to accommodate the lamp wire after it is threaded through a truck hole (e.g., truck hole 202) of the skateboard deck 110. The remaining section of the lamp wire (e.g., the third lamp wire section 702*c*) is used to connect the first light bulb socket 303*a* of the light bulb 102 to the power supply. For example, the third lamp wire section 702*c* traverses the central portion 317, which is hollowed.

Figure 8A:
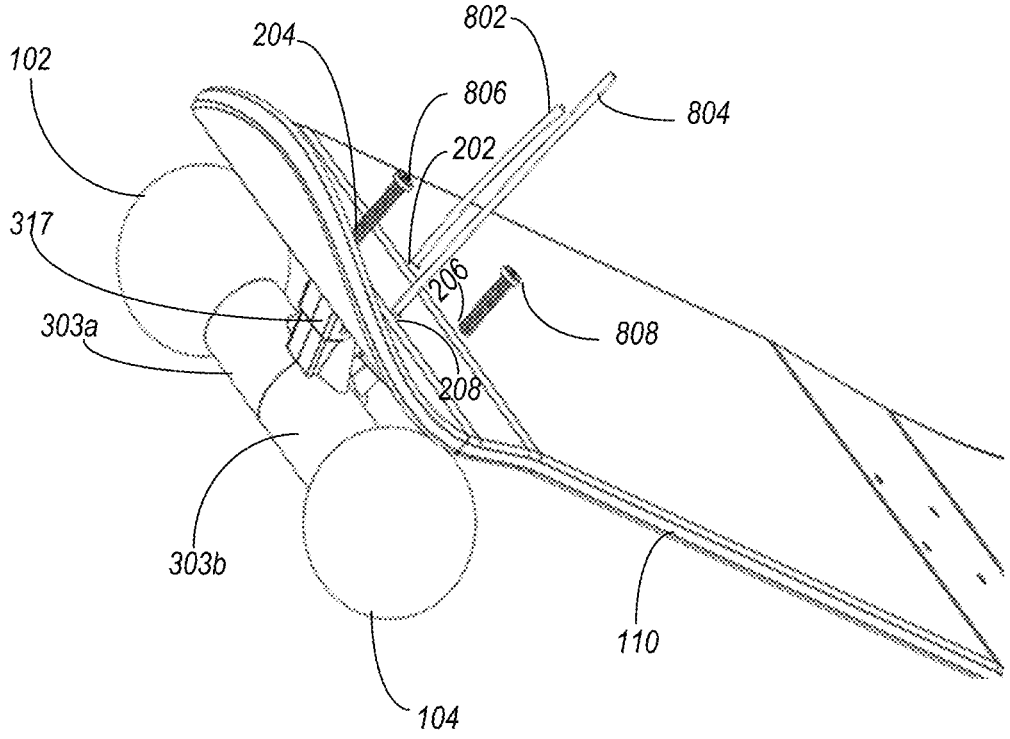
FIGS. 8A and 8B illustrate different views of the skateboard lamp, according to aspects of the present disclosure.
Figure 8B:
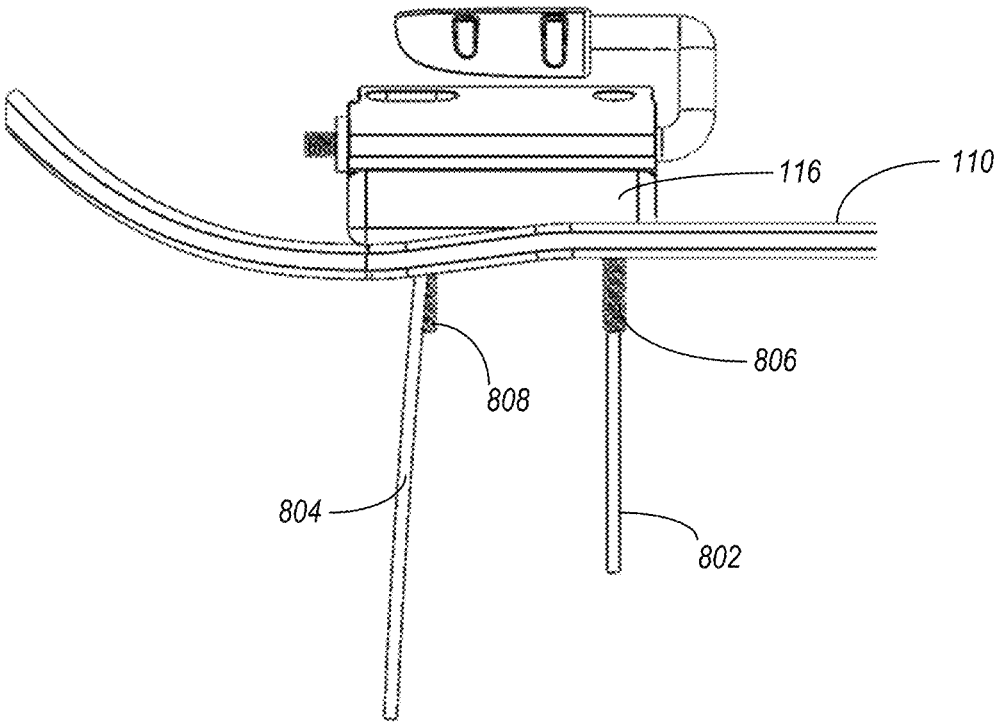

FIGS. 8A and 8B illustrate different views of a skateboard lamp, according to aspects of the present disclosure. Bolts 806 and 808 may be used to attach the skateboard truck assembly with the light bulbs 102 and 104 to the skateboard deck 110. For example, some of the truck holes (e.g., truck holes 202 and 208) may be used for routing lamp wires 802 and 804 to provide power supply to the light bulbs 102 and 104. The other truck holes (e.g., truck holes 204 and 206) may be used for securing the first lamp truck assembly 106 to the skateboard deck 110.

Figure 9:
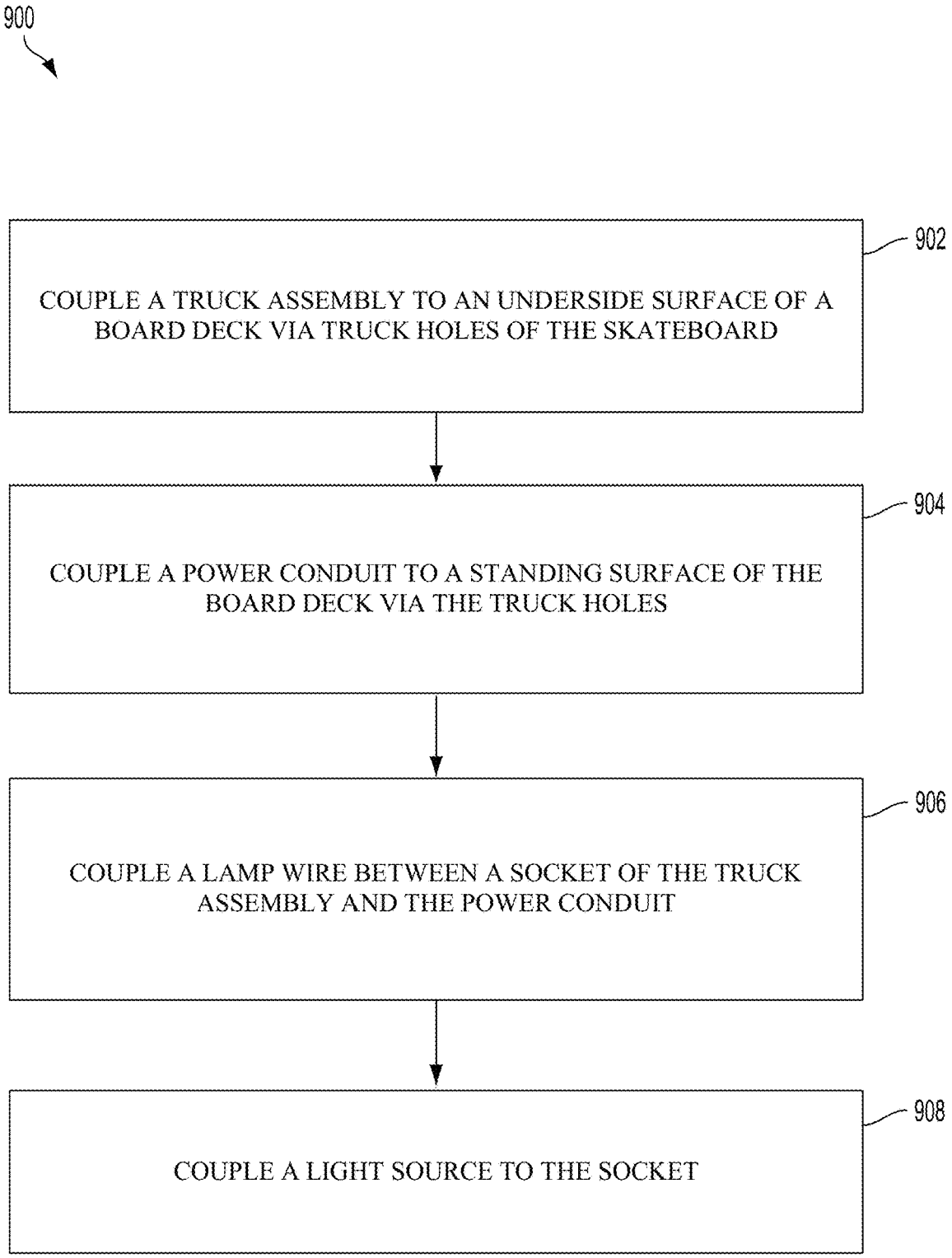
FIG. 9 depicts a simplified flowchart of a method of re-using a skateboard as a lamp, according to aspects of the present disclosure.

FIG. 9 depicts a flowchart of a method 900 of creating a light assembly via a skateboard deck according to aspects of the present disclosure. The skateboard deck is not limited to a skateboard. For simplicity, the skateboard deck is used as an example. Other types of decks, such as a snowboard, may be used. As discussed, the skateboard may be re-purposed as a lamp. At block 902, a truck assembly is coupled to an underside surface of the board deck via truck holes of the skateboard deck. The truck assembly may be coupled via two or more truck holes. Attaching devices, such as screws, nuts, bolts, etc., may be used to couple to truck assembly to the skateboard.

The truck holes are originally intended to couple a wheel axle truck assembly to the underside surface of the skateboard deck (e.g., board deck). In the present configuration, the wheel axle truck assembly is no longer attached to the skateboard deck. When used as a transportation device, the wheels coupled to a wheel axle of the wheel axle truck assembly provided locomotion to the skateboard deck. The board deck may originally include two or more wheel axles. In most cases, the skateboard deck includes four truck holes towards the front of the skateboard deck and four truck holes towards the rear of the skateboard deck.

The truck assembly for the lamp may be different from the wheel axle truck assembly. The truck assembly for the lamp may be referred to as a light truck assembly. In one configuration, the truck assembly includes a base plate and a central portion. The base plate may include multiple openings that are aligned with the truck holes. The central portion may be hollow. Additionally, the central portion includes one or more sockets for receiving a light source, such as a light bulb. The base plate is at a periphery of the skateboard truck assembly.

At block 904, a power conduit is coupled to a standing surface of the skateboard deck via the truck holes. The standing surface faces a direction that is opposite a direction of the underside surface. The power conduit may be coupled via two or more truck holes. Attaching devices, such as screws, nuts, bolts, etc., may be used to couple the power conduit to the skateboard deck. The power conduit may also be coupled to the truck assembly. The power conduit may be coupled to an external power source, such as a wall socket, to receive power. Additionally, or alternatively, the power conduit is coupled to an internal power source, such as a battery.

At block 906, a lamp wire is coupled with a socket of the truck assembly and the power conduit. The lamp wire extends through one or more truck holes. Additionally, the lamp wire is used to provide power to the light source. That is, the lamp wire provides power received at the power conduit to the light source that is coupled to the socket. In one configuration, the lamp wire includes a hot wire and a neutral wire. The hot wire may extend through a first truck hole and the neutral wire may extend through a second truck hole. Aspects of the present disclosure are not limited to using the first and second truck holes.

A flush wire gap may be defined between the skateboard deck and an underside of the base plate to create a path for the lamp wire to traverse to the socket. The lamp wire may traverse through an unexposed region of the base plate to a hollow portion of the truck assembly.

At block 908, the light source is coupled to the socket. The truck assembly may include multiple sockets. Additionally, the skateboard deck may include multiple truck assemblies.

Although the present disclosure and its advantages have been described in detail, it should be understood that various changes, substitutions, and alterations can be made herein without departing from the technology of the disclosure as defined by the appended claims. For example, relational terms, such as "above" and "below" are used with respect to a substrate or electronic device. Of course, if the substrate or electronic device is inverted, above becomes below, and vice versa. Additionally, if oriented sideways, above and below may refer to sides of a substrate or electronic device. Moreover, the scope of the present application is not intended to be limited to the particular configurations of the process, machine, manufacture, and composition of matter, means, methods, and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

What is claimed is:

1. A skateboard deck lamp, comprising:

a deck comprising a plurality of truck holes, a standing surface, and an underside surface, the plurality of truck holes originally intended to couple the deck to a wheel axle truck assembly;

a plurality of truck assemblies coupled to the underside surface, each truck assembly comprising:

a base plate comprising openings aligned with a plurality of truck holes, and a central portion comprising a pair of sockets, each socket for receiving a light source; and a plurality of power supply conduits coupled to the standing surface, each power supply conduit:

coupled to the standing surface via one subset of truck holes of the plurality of truck holes;

receiving electricity from a power source; and enclosing a set of lamp wires, such that the set of lamp wires are not exposed to the standing surface, each set of lamp wires comprising a hot lamp wire and a neutral lamp wire; and a plurality of mounts for mounting the skateboard deck lamp to a flat surface, each mount of the plurality of mounts coupled to one of the plurality of power supply conduits.

2. The skateboard deck lamp of claim 1, further comprising a flush wire gap defined between the underside surface and the base plate of each one of the plurality of truck assemblies.

3. The skateboard deck lamp of claim 1, in which each truck assembly of the plurality of truck assemblies is coupled to the underside surface via at least one truck hole.

4. The skateboard deck lamp of claim 1, in which each power supply conduit of the plurality of power supply conduits is coupled to the standing surface via at least one truck hole.

5. The skateboard deck lamp of claim 1, in which:

the central portion of each truck assembly comprises a plurality of sockets, and the lamp wire provides power to the light source coupled to each socket of the plurality of sockets.

6. The skateboard deck lamp of claim 1, in which each power supply conduit of the plurality of power supply conduits comprises conduit holes aligned with one subset of truck holes of the plurality of truck holes.

7. The skateboard deck lamp of claim 1, in which the underside surface faces a first direction and the standing surface faces a second direction, the first direction being opposite of the second direction.

8. A method of creating a light assembly via a skateboard deck, comprising:

coupling each one of a plurality of truck assemblies to an underside surface of the skateboard deck via a subset of truck holes of a plurality of truck holes of the skateboard deck, each one of the plurality of truck assemblies comprising a socket for receiving a light source;

aligning openings of a base plate of each one of the plurality of truck assemblies with one subset of the plurality of truck holes;

coupling each power conduit of a plurality of power conduits to a standing surface of the skateboard deck via one subset of the plurality of truck holes;

enclosing a set of lamp wires within each power conduit of the plurality of power conduits, such that the set of lamp wires are not exposed to the standing surface;

coupling each set of lamp wires to the socket of one the plurality of truck assemblies by extending each lamp wire of each set of lamp wires through one truck hole of the plurality of truck holes; and coupling the skateboard deck to a flat surface via a plurality of mounts, each mount of the plurality of mounts coupled to one of the plurality of power supply conduits.

9. The method of claim 8, further comprising providing power to the light source via the lamp wire.

10. The method of claim 8, in which each one of the plurality of truck assemblies comprises a plurality of sockets.

11. The method of claim 8, further comprising coupling each one of the plurality of truck assemblies to the underside surface via two truck holes.

12. The method of claim 8, further comprising coupling each one of the plurality of power supply conduits to the standing surface via two truck holes.

13. The method of claim 8, in which the lamp wire comprises a hot wire and a neutral wire.

14. The method of claim 13, further comprising extending the hot wire through a first truck hole of one of the subset of truck holes and extending the neutral wire through a second truck hole of one of the subset of truck holes.

* * * * *